US006705304B1

(12) United States Patent
Pauluhn

(10) Patent No.: US 6,705,304 B1
(45) Date of Patent: Mar. 16, 2004

(54) CROSSBOW COCKING MECHANISM

(76) Inventor: Adam Cuthbert Pauluhn, 5877 Niwot Rd., Niwot, CO (US) 80503

( * ) Notice: Subject to any disclaimer, the term of this patent is extended or adjusted under 35 U.S.C. 154(b) by 0 days.

(21) Appl. No.: 10/421,211

(22) Filed: Apr. 23, 2003

Related U.S. Application Data

(60) Provisional application No. 60/374,570, filed on Apr. 23, 2002.

(51) Int. Cl.[7] ..... F41B 5/12
(52) U.S. Cl. ..... 124/25
(58) Field of Search ..... 124/25

(56) References Cited

U.S. PATENT DOCUMENTS 4,719,897 A 1/1988 Gaudreau
4,942,861 A 7/1990 Bozek
5,243,956 A * 9/1993 Luehring
5,823,172 A 10/1998 Suggitt
6,286,496 B1 9/2001 Bednar

* cited by examiner

*Primary Examiner*—John A. Ricci
(74) *Attorney, Agent, or Firm*—Parsons & Goltry; Robert A. Parsons; Michael W. Goltry

(57) ABSTRACT

A crossbow including a stock having a forward end and a rearward end, a bow member mounted on the stock proximate the forward end with a bow string movable between a released position and a drawn position, a trigger mechanism including a latch for engaging and holding the bow string in the drawn position and selectively releasing the bow string into the released position when disengaged. The crossbow further includes a cocking mechanism having a string engaging member with a hook portion engaging the bow string in the released position and drawing the bow string to the drawn position in response to movement of a slide slidably mounted to an underside of the stock. A line has an end coupled to the slide and an opposing end coupled to the string engaging member. The line extends forwardly from the grip around the first guide, extending rearwardly from the first guide around the second guide and extending forwardly to couple to the string engaging member.

15 Claims, 5 Drawing Sheets

CROSSBOW COCKING MECHANISM

CROSS-REFERENCE TO RELATED APPLICATIONS

This application claims the benefit of U.S. Provisional Application No. 60/374,570, filed Apr. 23, 2002.

FIELD OF THE INVENTION

This invention relates to crossbows.

More particularly, the present invention relates mechanisms for drawing the bow string of a crossbow from a released position to a drawn position.

BACKGROUND OF THE INVENTION

Crossbows are well known projectile devices that have been around for centuries. During most of that time, the basic structure of the crossbow has remained relatively unchanged, with modifications to the trigger mechanism, changes in the materials used in its construction and many innovations in devices and mechanisms for drawing the bowstring into the cocked position. A large amount of time an effort has been expended on developing a simple and easily used cocking mechanism over the years. However, each has been less than satisfactory. The simplest form of cocking is performed manually. The bow string is grasped by hand or hands, and drawn to the cocked position. This method is simple and quick, but becomes more difficult as the draw weight of the bow increases. Claws, hooks, etc. with handles, are often utilized to provide a better grip on the bow string. However, strength is still needed to draw the bow string. Over the years external mechanical aids have also been developed. These, however, are typically bulky, difficult to use and inconvenient to carry with the crossbow.

More successful are devices that are attached to or carried by the crossbow. These devices include cranks and levers for drawing the bow string into the cocked position. Cranks most simply pull a line connected to the bow string onto a spindle. Levers employ one or more lever elements to pull the bow string back. Each is effective, but can be cumbersome and awkward to employ.

It would be highly advantageous, therefore, to remedy the foregoing and other deficiencies inherent in the prior art.

Accordingly, it is an object of the present invention to provide a new and improved crossbow cocking mechanism.

Another object of the invention is to provide a crossbow cocking mechanism which is inexpensive and easy to use.

And another object of the invention is to provide a crossbow cocking mechanism which provides a mechanical advantage to overcome the draw weight of the crossbow.

SUMMARY OF THE INVENTION

Briefly, to achieve the desired objects of the instant invention in accordance with a preferred embodiment thereof, provided is a crossbow including a stock having a forward end an a rearward end, a bow member mounted on the stock proximate the forward end, and having a bow string movable between a released position and a drawn position. A trigger mechanism is carried by the stock, and includes a trigger coupled to a latch. The latch for engages and holds the bow string in the drawn position and selectively releases the bow string into the released position when disengaged. A cocking mechanism is carried by the stock and includes a string engaging member moveable between a ready position and a cocked position. The string engaging member includes a hook portion engaging the bow string in the released position and drawing the bow string to the drawn position when moved to the cocked position. A slide is slidably mounted to an underside of the stock and movable forwardly toward the forward end and rearwardly toward the rearward end. A first guide is mounted to the stock proximate the forward end and a second guide is mounted to the stock proximate the rearward end. A line has an end coupled to the slide and an opposing end coupled to the string engaging member. The line extends forwardly from the grip around the first guide, extends rearwardly from the first guide around the second guide and extends forwardly to couple to the string engaging member.

In a further embodiment of the invention, a second line with guides is attached between the slide and the string engaging member. In yet another embodiment, the end of the line is coupled to the string engaging member with a cocking cog in a block and tackle arrangement.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
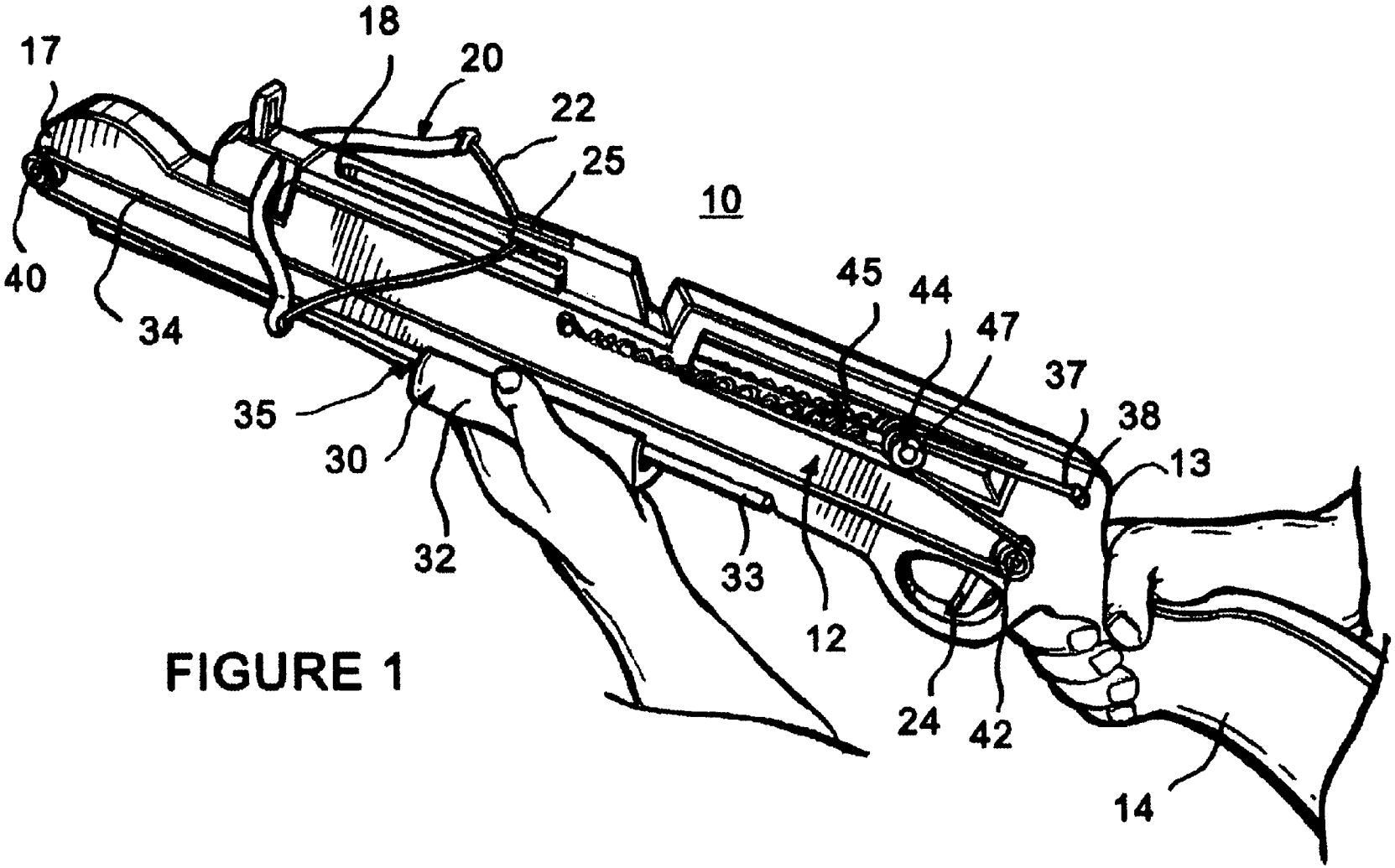
FIG. 1 is a perspective view illustrating a crossbow according to the present invention, illustrated in a cocked configuration.
Figure 2:
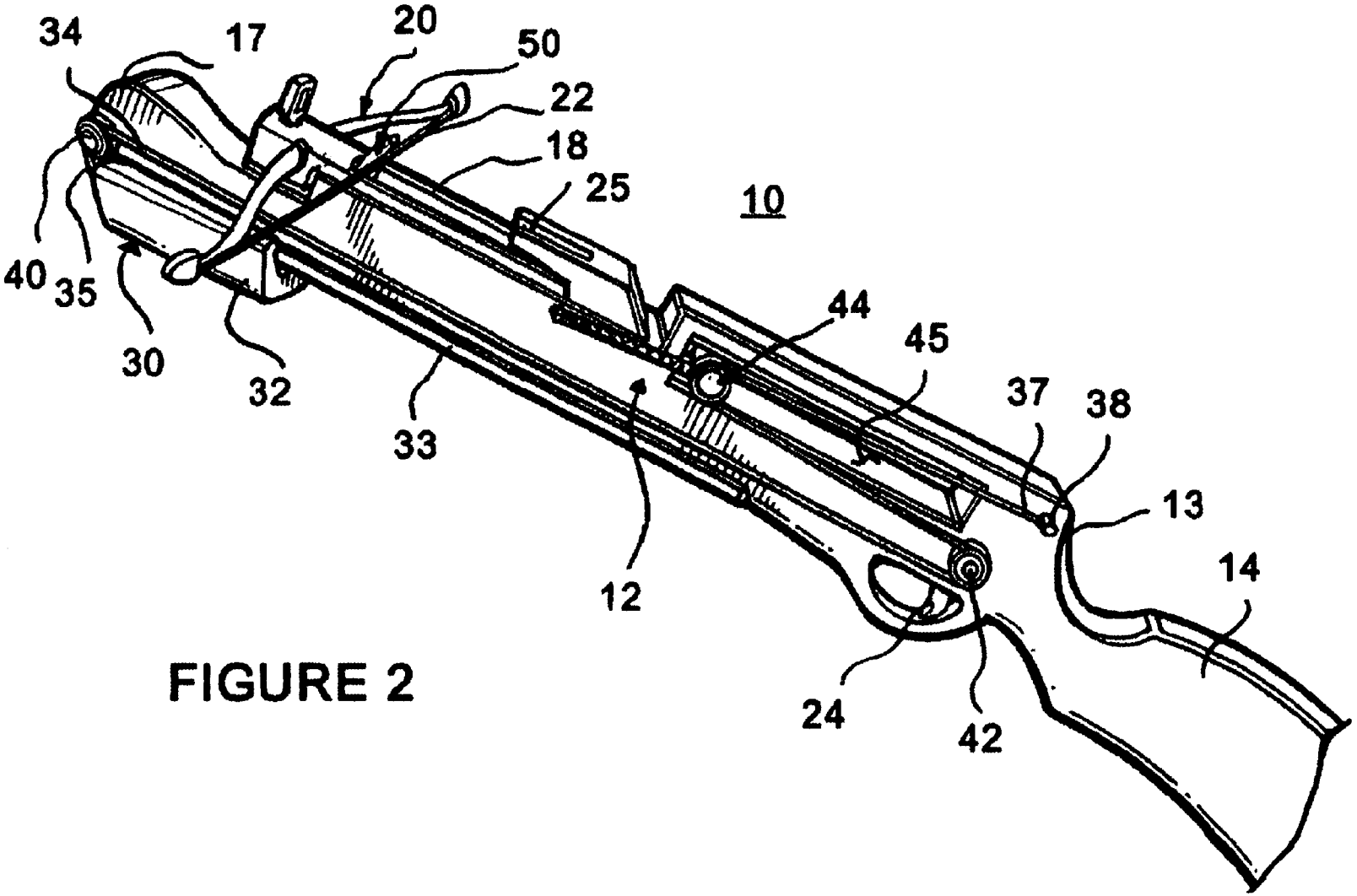
FIG. 2 is a perspective view of the crossbow of FIG. 1, illustrated in a released configuration.
Figure 3:
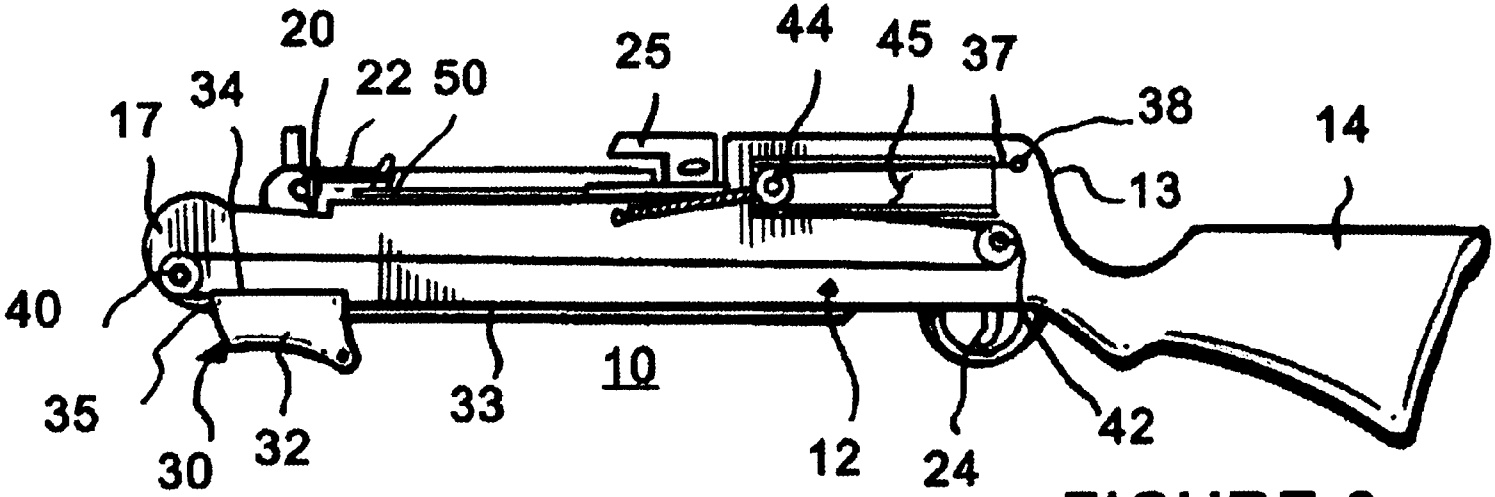
FIG. 3 is a side view of the crossbow of FIG. 1, illustrated in the released configuration.
Figure 4:
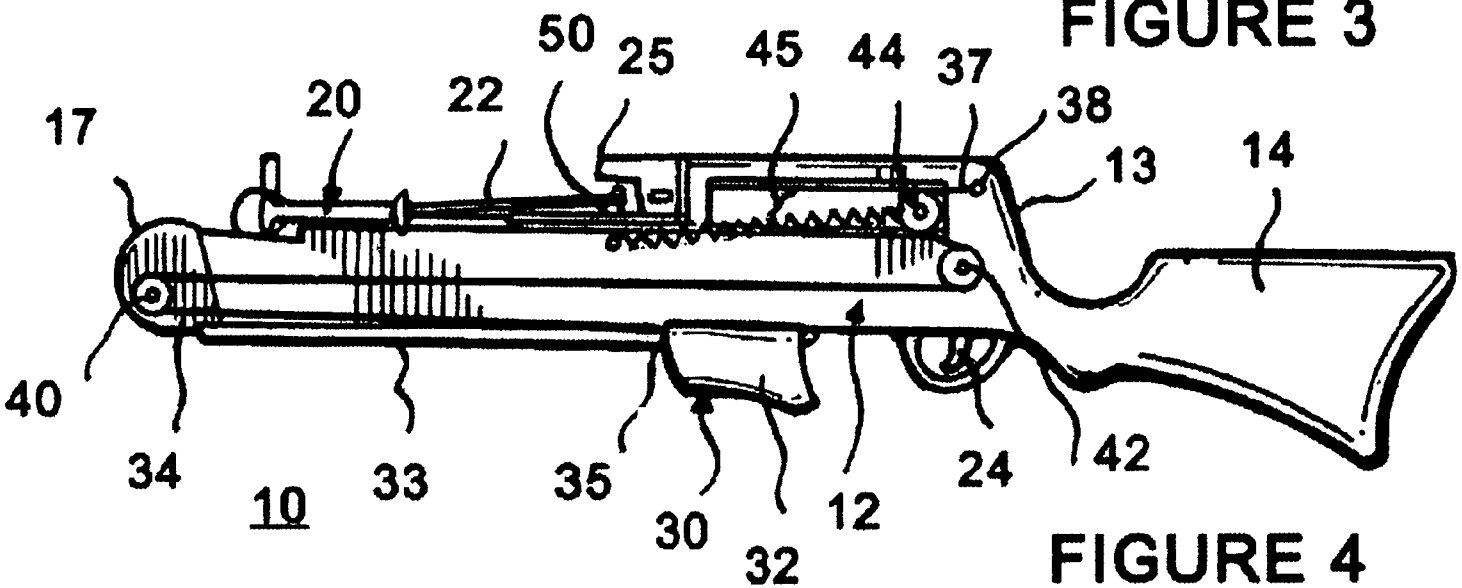
FIG. 4 is a side view of the crossbow of FIG. 1, illustrated in the cocked configuration.

Turning now to the drawings in which like reference characters indicate corresponding elements throughout the several views, attention is first directed to FIG. 1 which illustrates a crossbow generally designated 10. Crossbow 10 is substantially of any conventional construction, and includes a stock 12 having a rearward end 13 from which a butt portion 14 extends, and a forward end 17. Stock 12 includes a slide 18 to mount a bolt, and carries a bow 20 with bow string 22 proximate forward end 17. Bow string 22 is movable between a released position (FIG. 2), and a drawn position (FIG. 1) wherein bow string 22 is pulled toward rearward end 13. A trigger mechanism is carried by stock 12 and includes a trigger 24 mounted proximate rearward end 13 and a latch 25. Latch 25 engages and retains bow string 22 in the drawn position and selectively releases bow string 22 into the released position when disengaged from bow string 22. The trigger mechanism, including links between trigger 24 and latch 25, is not described in further detail, as substantially any trigger mechanism can be employed, and these mechanisms are well known in the art.

A cocking mechanism, generally designated 30 is carried by stock 12, and operates to move bow string 22 from the released position to the drawn position, where bow string 22 is engaged by latch 25 and held until trigger 24 is actuated.

Cocking mechanism 30 includes a reciprocating slide 32 slidably mounted to the underside of stock 12 by a track 33. Forward and rearward reciprocating movement of slide 32 can be facilitated by the use of bearings or the like, and it will be understood that track 33 can be rails, grooves, rods, etc.

Referring to one side of crossbow 10, a line 34 has an end 35 coupled to slide 32 and an end 37 coupled to stock 12 at an anchor 38 proximate rearward end 13, rearward of latch 25. Line 34 is a flexible elongated member, such as a string, rope cable, strap, etc. A guide 40 is mounted to stock 12 proximate forward end 17 and a guide 42 is mounted to stock 12 proximate rearward end 13 and below anchor 38. Line 34 extends forwardly from slide 32 and passed around guide 40 to extend rearwardly and pass around guide 42. A segment of line 34 between guide 42 and anchor 38 is increased when slide 32 is moved forwardly, towards forward end 17, and decreased when slide 32 is moved rearwardly, toward rearward end 13 for reasons which will be described presently. It will be understood by those skilled in the art that guides 40 and 42 are intended to position line 34 and allow line 34 to easily pass therearound. To this end, guides 40 and 42 are preferably wheels to reduce drag or friction on line 34. However, it will be understood that other guides may be employed, such as posts, rollers and the like.

Figure 5:
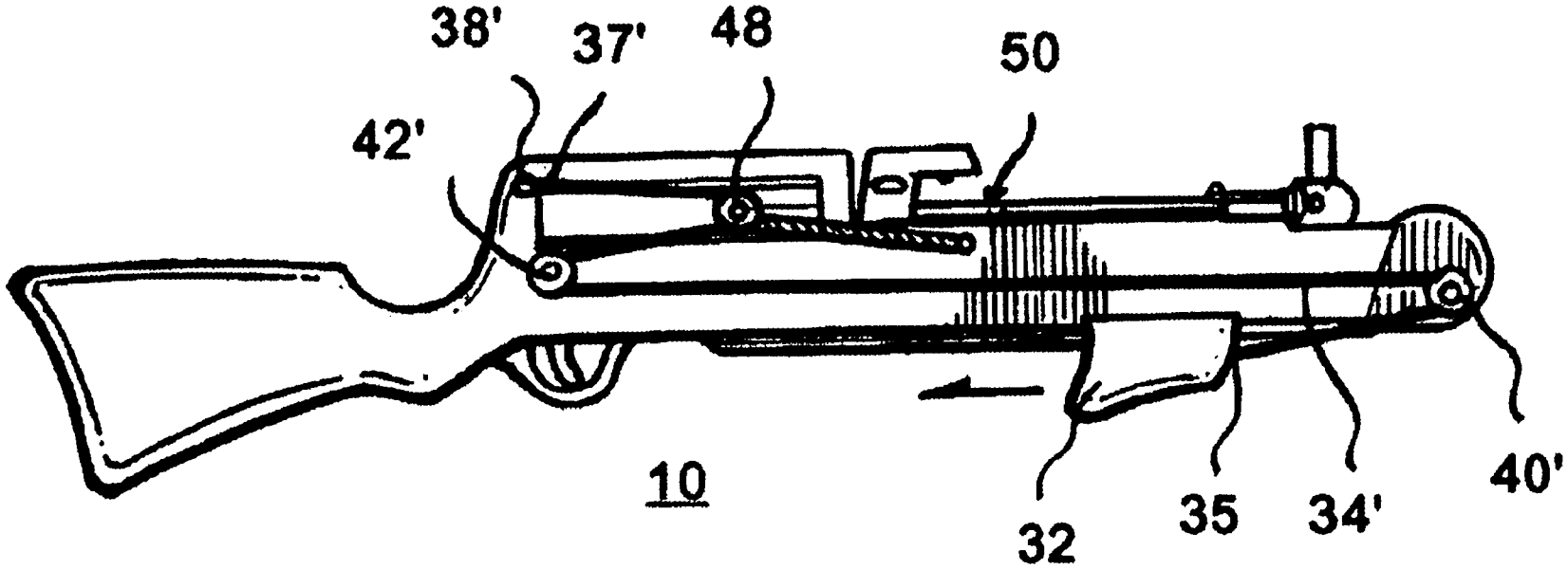
FIG. 5 is a reverse side view of the crossbow of FIG. 3.

Additionally, while only one side of crossbow 12 has been described in detail, with reference to FIG. 5, the same arrangement is provided for the other side of crossbow 10. A line 34' has an end 35' coupled to slide 32 and an end 37' coupled to stock 12 at an anchor 38' proximate rearward end 13, rearward of latch 25. Line 34' extends around guides 40' and 42'. Only one side is described in detail, as they are substantially identical.

Figure 6:
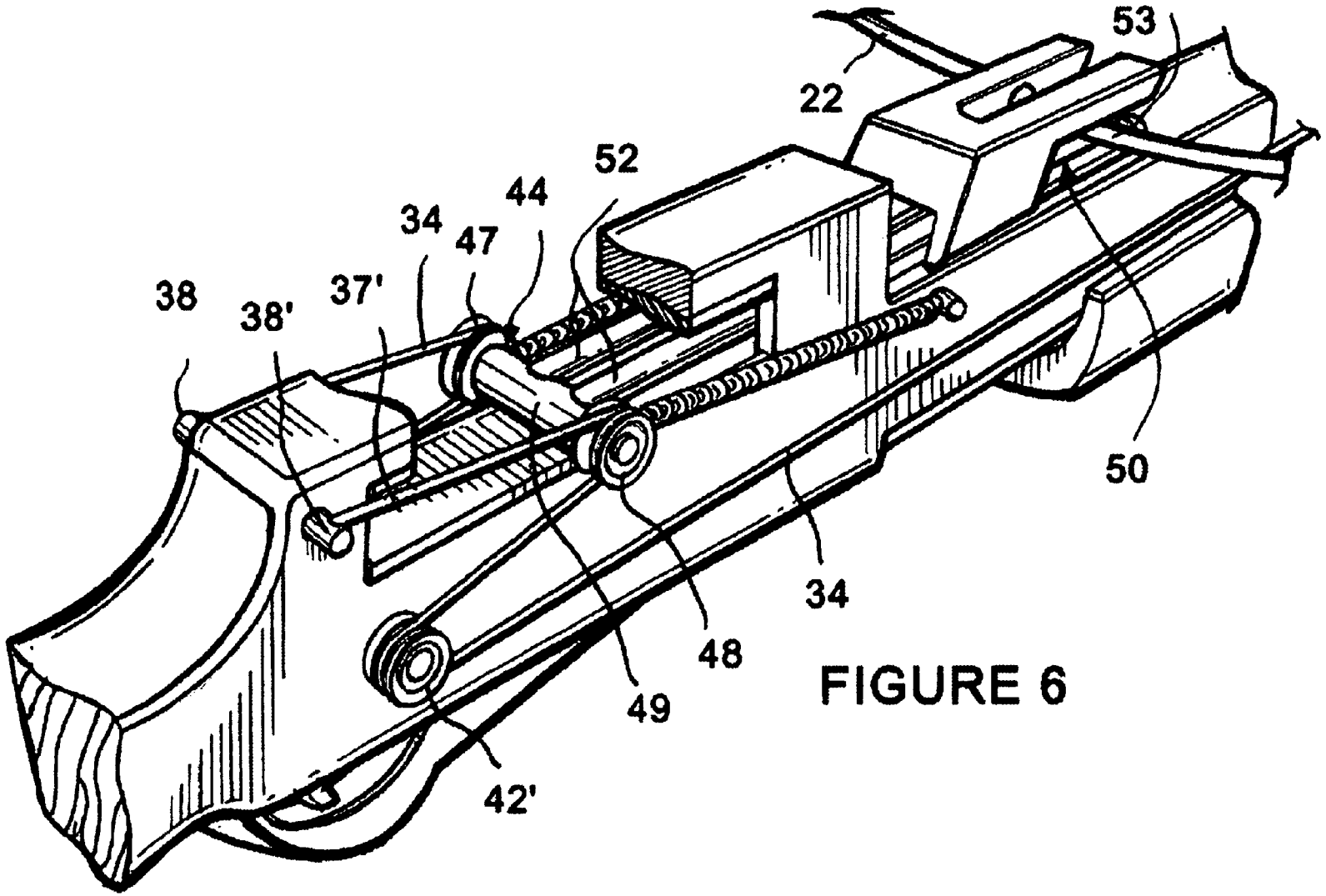
FIG. 6 is an enlarged partial perspective view of the crossbow with portion broken away.

Referring back to FIGS. 1–4, a cocking cog 44 is reciprocally mounted within a channel 45 formed in stock 12 intermediate latch 25 and anchor 38. With additional reference to FIG. 6, cocking cog includes pulleys 47 and 48 coupled by an axle 49. The segment of line 34 between guide 42 and anchor 38 passes around pulley 47 while the like portion of line 34' passes around pulley 48. A string engagement member 50 is slidably carried by stock 12 and movable between a ready position and a cocked position. String member 50 includes a pair of rods 52 each terminating in a hook portion 53 at a forward end, and having the rearward end coupled to axle 49 of cocking cog 44. Typically, hook portion 53 is bifurcated so as to engage bow string 22 on either side of a portion to be engaged by latch 25. Therefore, two rods can be provided each terminating in a hook and coupled to axle 49, one rod can be provided terminating in a double hook, or conceivably, a single hook can be provided, although this is less efficient.

Thus, as slide 32 is moved rearwardly, cocking cog 44 and string engagement member 50 are also moved rearwardly to a cocked position, drawing bow string 22 into the drawn position. In the drawn position, bow string 22 is engaged and held by latch 25. When slide 32 is released, a biasing mechanism 60 pulls cocking cog 44 string engagement member 50 and slide 32 forwardly into a ready position again. In the ready position, string engagement member 50 is ready to draw bow string 22 back into the drawn position when released from latch 25. Biasing mechanism 60 includes tension springs 62 and 63 mounted on apposing sides of crossbow 10 with one end anchored to stock 12 and the other end coupled to cocking cog 44.

A mechanical advantage is provided by the block and tackle arrangement of cocking cog 44. In the preferred embodiment, as slide 32 is moved a certain distance, cocking cog 44 moves half that distance. This reduces the effort needed to overcome the draw weight of bow 20. Thus, a bow with greater draw weight can be used with less effort. As illustrated, a simple block and tackle has been created by guide 42 and 42' and cocking cog 44. In this instance, the ends 37 and 37' of lines 34 and 34' are coupled to string engaging member 50 by a block and tackle. A more complex one can be employed to increase the advantage. Those skilled in the art will understand that the advantage created by the block and tackle can be increased or eliminated as desired, according to the arrangement of the pulleys, positioning of anchor 38, etc. Additionally, the block and tackle arrangement can be removed, with ends 37 and 37' of lines 34 and 34' coupled directly to string engagement member 50, eliminating anchor 38 and cocking cog 44. In this example, a pump action cocking mechanism is provided with no mechanical advantage.

Various changes and modifications to the embodiments herein chosen for purposes of illustration will readily occur to those skilled in the art. For example, while the lines and guides are illustrated on the outside of the stock, it will be understood that a stock can be created containing channels and spaces for a single set of guides and one line passing through the middle thereof. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A crossbow comprising:

a stock having a forward end an a rearward end;

a bow member having a bow string, mounted on the stock proximate the forward end, the bow string movable between a released position and a drawn position;

a trigger mechanism carried by the stock, and including a trigger coupled to a latch, the latch for engaging and holding the bow string in the drawn position and selectively releasing the bow string into the released position when disengaged; and a cocking mechanism comprising:

a string engaging member moveable between a ready position and a cocked position and including a hook portion engaging the bow string in the released position and drawing the bow string to the drawn position when moved to the cocked position;

a slide slidably mounted to an underside of the stock and movable forwardly toward the forward end and rearwardly toward the rearward end;

a first guide mounted to the stock proximate the forward end;

a second guide mounted to the stock proximate the rearward end; and a line having an end coupled to the slide and an opposing end coupled to the string engaging member, the line extending forwardly from the grip around the first guide, extending rearwardly from the first guide around the second guide and extending forwardly to couple to the string engaging member.

2. A crossbow as claimed in claim 1 wherein the cocking mechanisms further includes a block and tackle coupling the opposing end of the line to the string engagement member.

3. A crossbow as claimed in claim 2 wherein the block and tackle includes an anchor fixing the opposing end of the line to the stock above the second guide and a pulley movably mounted in a slot defined in the stock intermediate the anchor and the latch.

4. A crossbow as claimed in claim 1 further including the line, the first guide, the second guide coupled to one side of the stock and further including:

a third guide mounted to the stock proximate the forward end on an opposing side of the stock;

a fourth guide mounted to the stock proximate the rearward end on the opposing side of the stock; and a second line having an end coupled to the slide and an opposing end coupled to the string engaging member, the line extending forwardly from the grip around the third guide, extending rearwardly from the third guide around the fourth guide and extending forwardly to couple to the string engaging member.

5. A crossbow as claimed in claim 4 wherein the cocking mechanisms further includes a first block and tackle coupling the opposing end of the line to the string engagement member and a second block and tackle coupling the opposing end of the second line to the string engagement member.

6. A crossbow as claimed in claim 5 wherein the first block and tackle includes a first anchor fixing the opposing end of the line to the stock above the second guide and a first pulley movably mounted in a slot defined in the stock intermediate the anchor and the latch, the line extending forwardly from the anchor around the first pulley and rearwardly to the second guide and the second block and tackle includes a second anchor fixing the opposing end of the second line to the stock above the fourth guide and a second pulley movably mounted in the slot defined in the stock, the second line extending forwardly from the second anchor around the second pulley and rearwardly to the fourth guide.

7. A crossbow as claimed in claim 1 wherein the cocking mechanism further includes a biasing mechanism urging the string engaging member to the ready position.

8. A cocking mechanism for a crossbow including a stock having a forward end an a rearward end, a bow member having a bow string, mounted on the stock proximate the forward end, the bow string movable between a released position and a drawn position, and a trigger mechanism carried by the stock, and including a trigger coupled to a latch, the latch for engaging and holding the bow string in the drawn position and selectively releasing the bow string into the released position when disengaged, the cocking mechanism comprising:

a slide slidably mounted to an underside of the stock and movable forwardly toward the forward end and rearwardly toward the rearward end;

a string engaging member moveable between a ready position and a cocked position and including a hook portion engaging the bow string in the released position and drawing the bow string to the drawn position when moved to the cocked position;

a first guide mounted to the stock proximate the forward end;

a second guide mounted to the stock proximate the rearward end; and a line having an end coupled to the slide and an opposing end coupled to the string engaging member, the line extending forwardly from the grip around the first guide, extending rearwardly from the first guide around the second guide and extending forwardly to couple to the string engaging member.

9. A cocking mechanism as claimed in claim 8 wherein the cocking mechanisms further includes a block and tackle coupling the opposing end of the line to the string engagement member.

10. A cocking mechanism as claimed in claim 9 wherein the block and tackle includes an anchor fixing the opposing end of the line to the stock above the second guide and a pulley movably mounted in a slot defined in the stock intermediate the anchor and the latch.

11. A cocking mechanism as claimed in claim 8 further including the line, the first guide, the second guide coupled to one side of the stock and further including:

a third guide mounted to the stock proximate the forward end on an opposing side of the stock;

a fourth guide mounted to the stock proximate the rearward end on the opposing side of the stock; and a second line having an end coupled to the slide and an opposing end coupled to the string engaging member, the line extending forwardly from the grip around the third guide, extending rearwardly from the third guide around the fourth guide and extending forwardly to couple to the string engaging member.

12. A cocking mechanism as claimed in claim 11 wherein the cocking mechanisms further includes a first block and tackle coupling the opposing end of the line to the string engagement member and a second block and tackle coupling the opposing end of the second line to the string engagement member.

13. A cocking mechanism as claimed in claim 12 wherein the first block and tackle includes a first anchor fixing the opposing end of the line to the stock above the second guide and a first pulley movably mounted in a slot defined in the stock intermediate the anchor and the latch, the line extending forwardly from the anchor around the first pulley and rearwardly to the second guide and the second block and tackle includes a second anchor fixing the opposing end of the second line to the stock above the fourth guide and a second pulley movably mounted in the slot defined in the stock, the second line extending forwardly from the second anchor around the second pulley and rearwardly to the fourth guide.

14. A cocking mechanism for a crossbow including a stock having a first side, a second side, a forward end an a rearward end, a bow member having a bow string, mounted on the stock proximate the forward end, the bow string movable between a released position and a drawn position, and a trigger mechanism carried by the stock, and including a trigger coupled to a latch, the latch for engaging and holding the bow string in the drawn position and selectively releasing the bow string into the released position when disengaged, the cocking mechanism comprising:

a slide slidably mounted to an underside of the stock and movable forwardly toward the forward end and rearwardly toward the rearward end;

a string engaging member moveable between a ready position and a cocked position and including a hook portion engaging the bow string in the released position and drawing the bow string to the drawn position when moved to the cocked position;

a cocking cog coupled to the string engaging member and reciprocally movable within a notch formed in the stock intermediate the latch and the rearward end;

a first guide mounted to the stock proximate the forward end on the first side of the stock;

a second guide mounted to the stock proximate the rearward end on the first side of the stock; and a first line having an end coupled to the slide and an opposing end coupled to a first anchor on the first side of the stock proximate the rearward end above the second guide, the line extending forwardly from the grip around the first guide, extending rearwardly from the first guide around the second guide extending forwardly around the cocking cog and extending rearwardly to the first anchor, a third guide mounted to the stock proximate the forward end on the second side of the stock;

a fourth guide mounted to the stock proximate the rearward end on the second side of the stock; and a second line having an end coupled to the slide and an opposing end coupled to a second anchor on the second side of the stock proximate the rearward end above the fourth guide, the second line extending forwardly from the grip around the third guide, extending rearwardly from the third guide around the fourth guide extending forwardly around the cocking cog and extending rearwardly to the second anchor.

15. A cocking mechanisms as claimed in claim 14 wherein the cocking cog includes a first pulley and a second pulley coupled by an axle.

* * * * *